US006683636B2

(12) United States Patent
Goto et al.

(10) Patent No.: US 6,683,636 B2
(45) Date of Patent: Jan. 27, 2004

(54) THERMAL HEAD, CLEANING METHOD THEREOF AND COLOR THERMAL PRINTER

(75) Inventors: Satoru Goto, Saitama (JP); Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/384,674

(22) Filed: Mar. 11, 2003

(65) Prior Publication Data

US 2003/0169326 A1 Sep. 11, 2003

(30) Foreign Application Priority Data

Mar. 11, 2002 (JP) ..... 2002-065220

(51) Int. Cl.[7] ..... B41J 2/335; B41J 29/17
(52) U.S. Cl. ..... 347/171; 347/175; 347/203
(58) Field of Search ..... 347/171, 175; 400/701, 702, 120.01, 120.02, 120.03, 120.04

(56) References Cited

U.S. PATENT DOCUMENTS 6,271,872 B1 8/2001 Nagata

FOREIGN PATENT DOCUMENTS

JP 11-268255 * 10/1999 ..... B41J/29/17

* cited by examiner

*Primary Examiner*—Huan Tran
(74) *Attorney, Agent, or Firm*—Sughrue Mion, PLLC

(57) ABSTRACT

In a thermal head, a partial glaze layer is formed on an alumina basal plate, and on that laminated are a heating body, an electrode and a protective layer. A photocatalytic layer composed of titanium oxide is provided on the protective layer. Stains of organic substances, adhered to the photocatalytic layer because of a transparent protective layer of a color thermal recording sheet softened in thermography, is photolized by ultraviolet ray from a magenta-fixing lamp, which loses a coloring capacity of a magenta thermal coloring layer.

18 Claims, 4 Drawing Sheets

THERMAL HEAD, CLEANING METHOD THEREOF AND COLOR THERMAL PRINTER

BACKGROUND OF THE INVENTION

1. Field of the Invention

The present invention relates to a thermal head, a cleaning method thereof that may remove organic substances adhered to the surface of the thermal head by photolyzation, and a color thermal printer.

2. Description Related to the Prior Art

As a thermal printer, the well-known type is a color thermal printer coloring and recording a full-color image by heating a color thermal recording sheet by means of the thermal head. The color thermal recording sheet is composed of a cyan thermal coloring layer on top of the base, a magenta thermal coloring layer, a yellow thermal coloring layer and a transparent protective layer laminated in the order mentioned. The yellow thermal coloring layer, the magenta thermal coloring layer, and the cyan thermal coloring layer are thermically recorded in the order mentioned when the color thermal recording sheet is pressed against the thermal head, to which a predetermined amount of thermal energy is sent. The transparent protective layer is provided for protecting the thermal coloring layers and improving the quality of print image by lustering the surface of the recording sheet. The transparent protective layer is composed of denatured-silica polyvinylalcohol (silica modified polyvinyl alcohol), silicon based lubricant, acetylene glycol, zinc stearate, and the like.

Since the thermal head is pressed against the color thermal recording sheet as recording image, the transparent protective layer is softened by heat, and its organic substances adhere on the surface of the thermal head as stains. Cleaning of the surface of the thermal head is required, as the stains deteriorate the quality of print image by hindering heat transfer. In U.S. Pat. No. 6,271,872, for example, a cleaning is executed by grinding the thermal head to remove the stains thereon by means of a cleaning sheet fed between the thermal head and a platen roller.

The conventional cleaning method, however, is to grind the surface of the heating elements with the use of cleaning sheet having a grind layer, and that causes a problem that the surface of the thermal head is abraded by being grinded, which deteriorates the quality of print image.

SUMMARY OF THE INVENTION

The present invention is invented in consideration of the problem described above, and an object of the present invention is to provide a thermal head and a cleaning method thereof that may clean the thermal head without touching it.

In order to achieve the above-described object, the thermal head of the present invention is characterized in being provided with a photocatalytic layer on the surface of the heating element array.

In a preferred embodiment, the thermal head is disposed in a color thermal printer that has a fixation lamp to generate fixation light for optical fixation of an image recorded on a recording sheet. The fixation light from the fixation lamp is reflected on a recording sheet guide toward the photocatalytic layer when the platen roller is shifted to be away from the heating element array. It is possible to guide the fixation light by rotating a part of a reflection plate to cover the fixation lamp. The fixation lamp and the heating element array may be swung to face each other so that fixation light is directly applied to the photocatalytic layer.

Since the photocatalytic layer photolyzes and removes the substances on the thermal head by applying ultraviolet light, it is possible to clean the thermal head without causing abrasion of the thermal head. Moreover, no exclusive lamp is required since the ultraviolet light is applied to the photocatalytic layer by the fixation lamp to fix the recorded image. Furthermore, since the fixation light is guided toward the photocatalytic layer, it is possible to apply the fixation light efficiently.

BRIEF DISCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
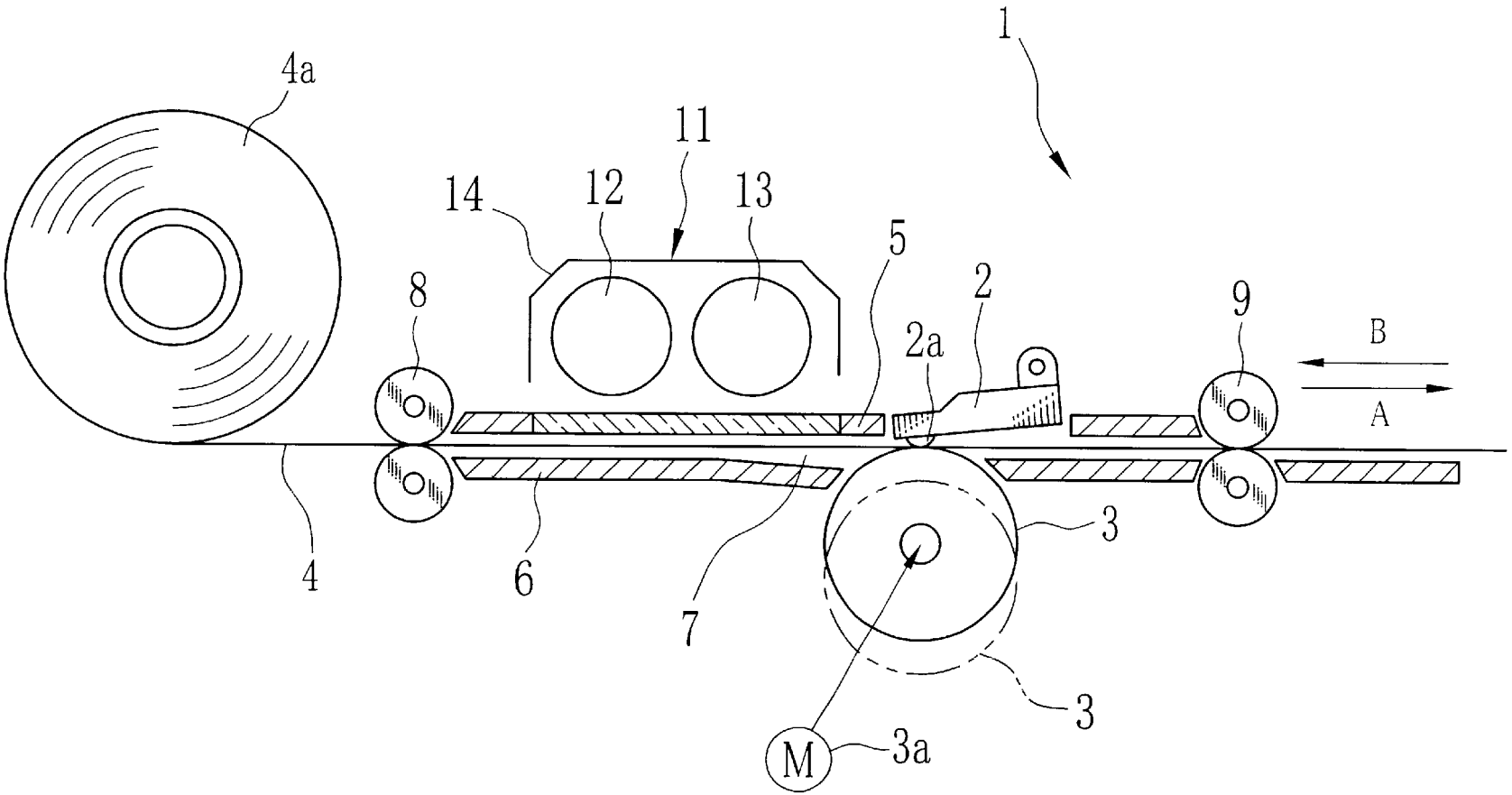
FIG. 1 is a schematic block diagram of a color thermal printer to which the present invention is applied.

As shown in FIG. 1, a color thermal printer 1 is provided with a thermal head 2, a platen roller 3 and an optical fixing device 11, and a roll of recording sheet 4*a*, wherein a color thermal recording sheet 4 is wound, is set in a holder not shown in FIG. 1. The platen roller 3 rotates when receiving driving force from a motor 3*a*. Following the rotation of the platen roller 3, a pair of sheet feeding rollers 8 and a pair of sheet ejecting rollers 9 rotate as well. A color thermal recording sheet 4 is drawn out from the roll of recording sheet 4*a* by the pair of sheet feeding rollers 8, and reciprocates into a feeding direction shown by one arrow A and a rewinding direction shown by another arrow B along a conveyance path formed between an upper guide plate 5 and a lower guide plate 6.

An array of heating elements 2*a*, wherein plural heating elements are lineally arranged in a main scanning direction vertical to the surface of the sheet, is formed on the thermal head 2, which is movably provided between a printing position for pressing the color thermal recording sheet 4 on the platen roller 3 and an evacuated position removed from the platen roller 3. The platen roller 3 shifts between a normal position for pressing the color thermal recording sheet 4 when the thermal head 2 is in the printing position and an evacuated position removed downwards from the normal position.

The optical fixing device 11 is composed of a yellow-fixing lamp 12, a magenta-fixing lamp 13 and a reflection plate 14. The yellow-fixing lamp 12 optically fixes yellow images by emitting near-ultraviolet light having a peak of emission wavelength in the vicinity of 420 nm. The magenta-fixing lamp 13 optically fixes magenta images by emitting ultraviolet light having a peak of emission wavelength in the vicinity of 365 nm. The magenta-fixing lamp 13 is provided close to the thermal head 2, while the yellow-fixing lamp 12 is provided away from the thermal head 2. The thermal head 2 is disposed so as to the array of heating elements 2*a* positions close to the optical fixing device 11.

Figure 2:
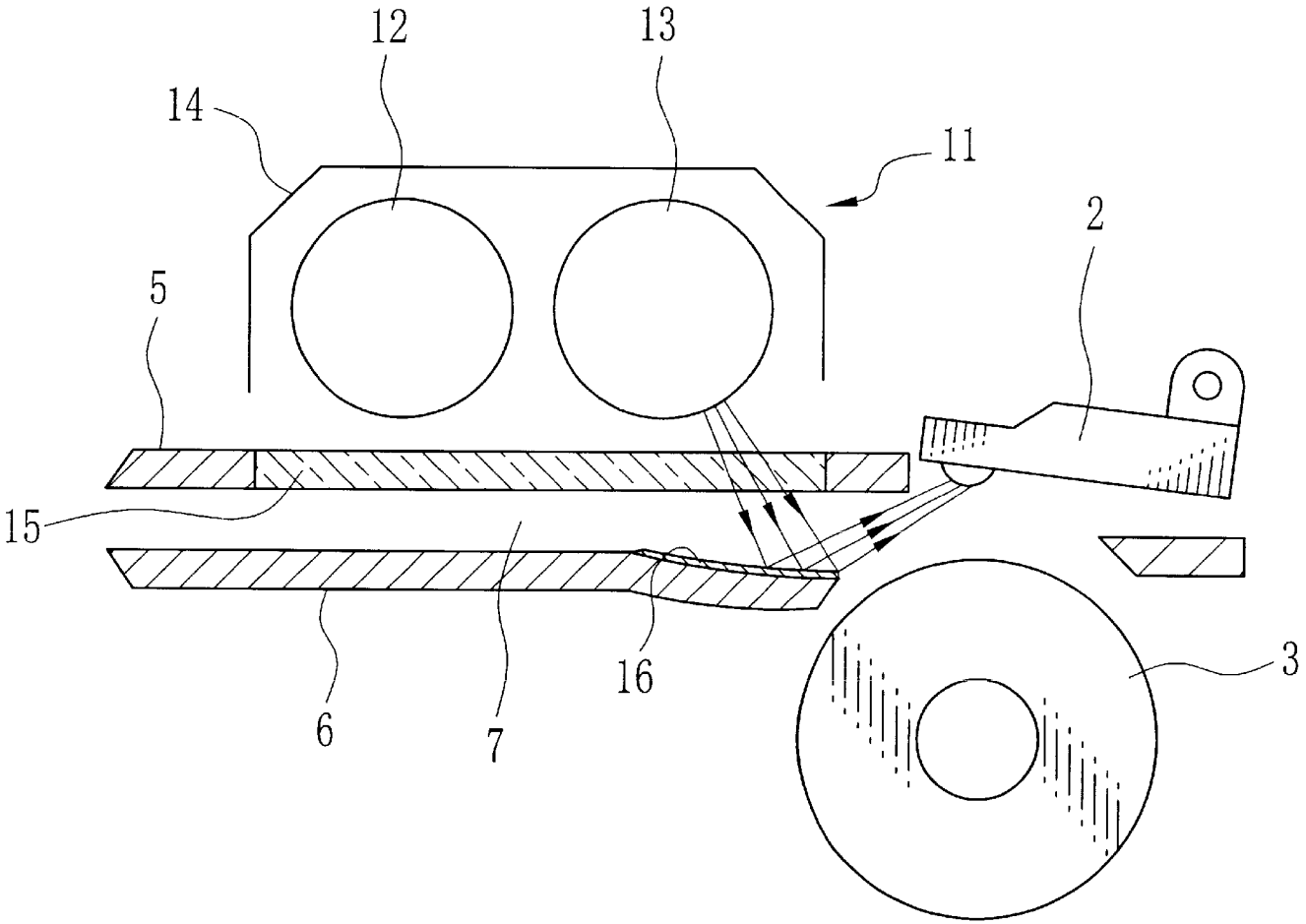
FIG. 2 is an enlarged view of the periphery of an optical fixing device.

As shown in FIG. 2, a transparent plate 15, made of acrylic and constituting a part of the upper guide plate 5, is disposed in between the optical fixing device 11 and the conveyance path. At the inner side of the lower guide plate 6, a mirror plane part 16 is provided on the inclined plane near the platen roller 3. The mirror plane part 16, in the form of a cylindrically concave mirror, is positioned in between the optical fixing device 11 and the platen roller 3. The mirror plane part 16 reflects ultraviolet light from the magenta-fixing lamp 13 toward the array of heating elements 2*a* of the thermal head 2 without dispersing it.

Figure 3:
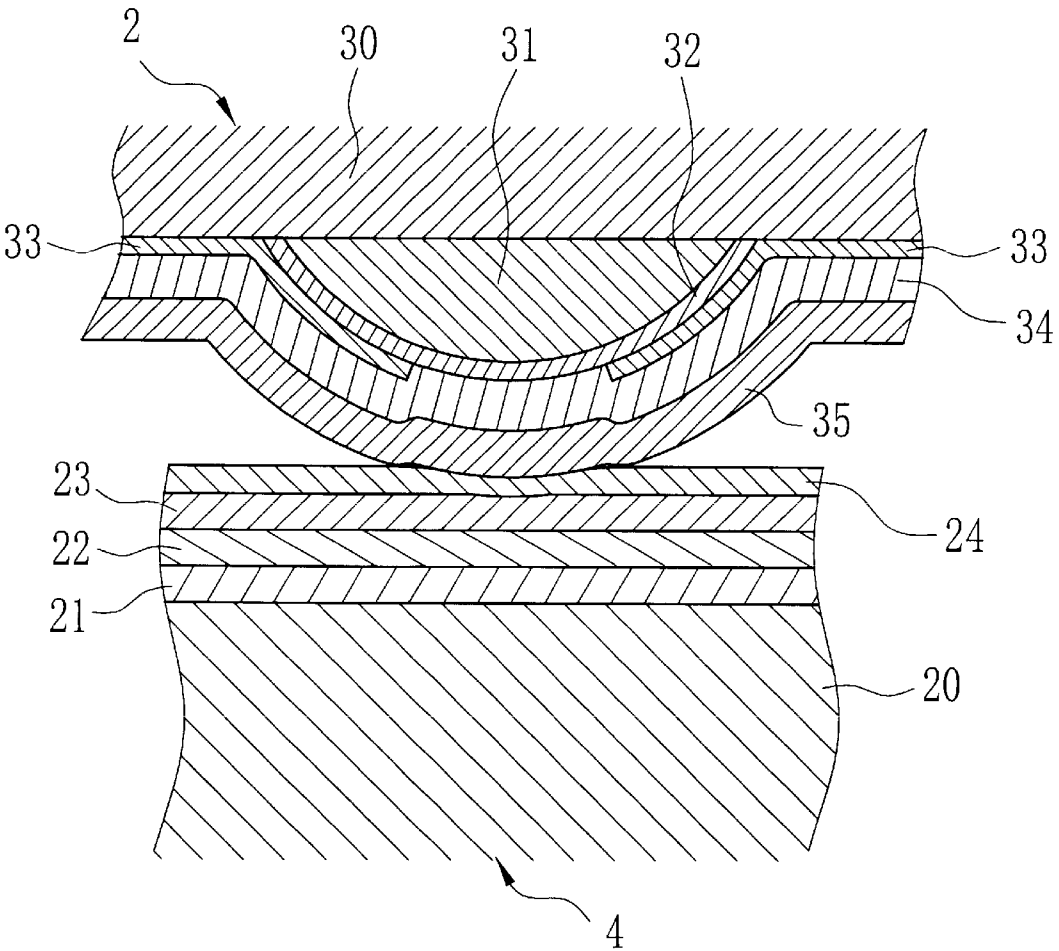
FIG. 3 is a cross sectional view illustrating compositions of a thermal head and a color thermal recording sheet.

As shown in FIG. 3, the color thermal recording sheet 4 is composed of a cyan thermal coloring layer 21, a magenta thermal coloring layer 22, and a yellow thermal coloring layer 23 and a transparent protective layer 24 laminated in the order mentioned on top of a transparent or white base 20. Note that interlayers provided between each thermal coloring layer are not shown in FIG. 3. The yellow thermal coloring layer 23 and the magenta thermal coloring layer 22 lose their coloring capacity by near-ultraviolet ray from the yellow-fixing lamp 12 and ultraviolet ray from the magenta-fixing lamp 13 respectively.

In the thermal head 2, a partial glaze layer 31, whose cross-sectional surface shapes a circular arc, is formed on an alumina basal plate 30. A heating body 32 and an electrode 33, on which a protective layer 34 is laminated, are provided on the partial glaze layer 31. On the protective layer 34, a photocatalytic layer 35 formed of titanium oxide is provided. When ultraviolet ray is exposed to the photocatalytic layer 35, the organic substances adhered to the surface of the photocatalytic layer 35 are photolyzed into water and gas components such as carbon dioxide and diffused into the air.

Next, functions of the present invention are explained. As the printing process is started, the pair of sheet feeding rollers 8 rotates, and the color thermal recording sheet 4 is fed toward the thermal head 2 thereby. The top of the color thermal recording sheet 4 is fed in the feeding direction A after passing the platen roller 3. The feeding stops when the rear end of the recording area on the color thermal recording sheet 4 reaches the thermal head 2. The thermal head 2 shifts to the printing position, and the color thermal recording sheet 4 is pressed between the array of heating elements 2*a* and the platen roller 3.

Then, on rotation of the platen roller 3, the color thermal recording sheet 4 is fed back into the rewinding direction B. The thermal head 2 is driven synchronously with feeding of the recording sheet, and yellow image is recorded on the yellow thermal coloring layer 23 line by line. The yellow-fixing lamp 12 is lit and exposes near-ultraviolet light to the color thermal recording sheet 4 to fix yellow image, as the area recorded yellow image reaches under the yellow-fixing lamp 12. When recording and optical fixation of yellow image are finished, the thermal head 2 shifts to the evacuated positions.

After that, the color thermal recording sheet 4 is fed into the feeding direction A again. When the rear end of the recording area passes the thermal head 2, the thermal head 2 shifts to the printing position. Magenta image is recorded on the magenta thermal coloring layer 22, as the array of heating elements 2*a* is driven synchronously with the rewinding of the color thermal recording sheet 4. The magenta-fixing lamp 13 is lit and exposes ultraviolet ray to the area where magenta image is recorded, so as to optically fix the magenta image.

Similarly, cyan image is recorded on the cyan thermal coloring layer 21, while the color thermal recording sheet 4 is once again fed into the feeding direction A and then in the rewinding direction B. Since the color thermal recording sheet 4 is heated to the highest temperature when recording cyan images, the transparent protective layer 24 is softened and a part of it adheres to the photocatalytic layer 35 on the surface of the thermal head 2. When the cyan image recording is finished, the color thermal recording sheet 4 is fed into the feeding direction A and ejected out of the printer by being nipped with a pair of sheet ejecting rollers 9. The part of the color thermal recording sheet 4, on which image is printed, is cut off by a cutter (not shown) and ejected out of the printer. Then, the unrecorded part of the color thermal recording sheet 4 is rewound toward the roll of recording sheet 4*a*.

Cleaning starts when the rewinding is finished. First, the platen roller 3 evacuates downwards, and the magenta-fixing lamp 13 is lit. Ultraviolet ray ejected from the magenta-fixing lamp 13 reflects on the mirror plane part 16 and then exposes the photocatalytic layer 35 on the surface of the heating elements. By ultraviolet ray, which is included in the magenta-fixing light, the organic substances of the transparent protective layer 24, adhered to the photocatalytic layer 35 while recording of cyan image, are photolyzed by photocatalysis oxidization. The organic substances are decomposed into water and carbon dioxide to be diffused into the air. When the magenta-fixing lamp 13 is extinguished after being lit for a predetermined time, the cleaning process finishes, which means that the printing process for one sheet is completed. For printing subsequent sheets, the above operation is repeated.

Though the cleaning process is executed after thermal recording in the above embodiment, note that it may be executed during preliminary lighting if the color thermal printer heats each lamp by lighting them up preliminary immediately after printing is started so as to drive each lamp stably. Also, the cleaning process may be executed after every printing of several sheets or at regular intervals. Apart from being reflected on the mirror plane provided on the lower guide plate, ultraviolet ray may also be guided to the array of heating elements 2*a* by light guides such as optical fibers.

Figure 4:
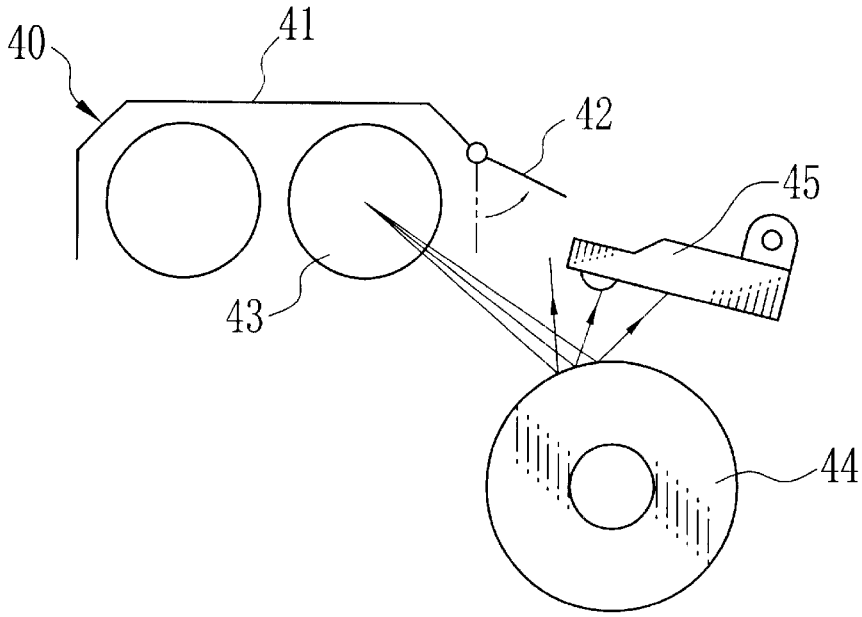
FIG. 4 is an explanation view of an embodiment wherein an openable door is provided for an optical fixing device.
Figure 5:
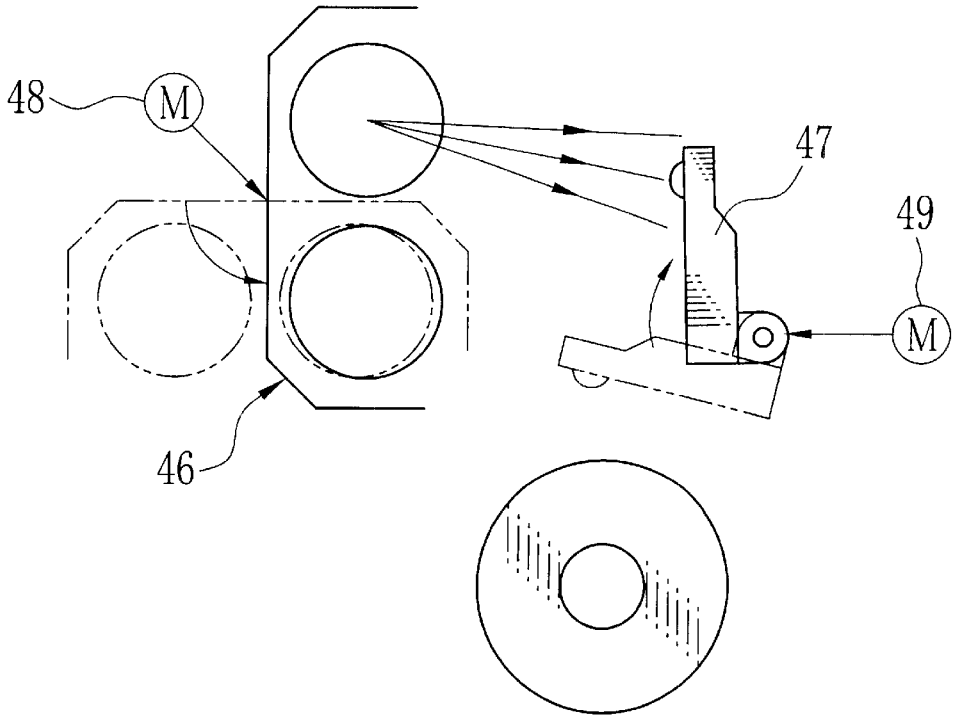
FIG. 5 is an explanation view of an embodiment wherein the optical fixing device and the thermal head are moved to face each other when cleaning is executed.

In order to efficiently expose ultraviolet ray to the photocatalyst, it is possible to provide an openable door 42 for a reflection plate 41 of an optical fixing device 40 and a driving source for opening and closing the door 42 as shown in FIG. 4. Thereby, the cleaning is executed by opening the door 42 so that the ultraviolet ray from the magenta-fixing lamp 13 reflects on the platen roller 44 to expose the array of heating elements 2*a* on a thermal head 45. Otherwise, as shown in FIG. 5, it is possible to construct an optical fixing device 46 and a thermal head 47 to be swingable respectively by motors 48 and 49 so that the thermal head 47 and the optical fixing device 46 face each other to execute cleaning.

Furthermore, the thermal head of the present invention may also be applied to a thermal transfer printer transferring ink on a film onto a recording sheet by fusing or subliming ink. In that case, installation of an exclusive lamp for ultraviolet ray is required for cleaning by photocatalysis. Additionally, though the protective layer and the photocatalytic layer are provided on the array of heating elements 2*a* in the above embodiment, it is possible to form the protective layer with a material having photocatalysis so as to improve efficiency of heat transfer to a recording material.

Various changes and modifications are possible in the present invention and may be understood to be within the present invention.

What is claimed is:

1. A thermal head for thermally recording an image onto a color thermal recording sheet, said thermal head comprising:

an array of heating elements wherein plural heating elements are lineally arranged; and a photocatalytic layer, covering said array of heating elements, to photolyze and remove substances adhered to the surface of said photocatalytic layer as exposed to light.

2. A thermal head described in claim 1, wherein said photocatalytic layer is exposed to fixation light for optical fixation of an image recorded on said color thermal recording sheet.

3. A thermal head described in claim 1, said thermal head further comprising:

a protective layer provided between said photocatalytic layer and said array of heating elements for protecting said heating elements.

4. A thermal head for thermally recording an image onto a color thermal recording sheet, said thermal head comprising:

an array of heating elements wherein plural heating elements are arranged lineally in a main scanning direction; and a protective layer for protecting the surface of said array of heating elements, said protective layer containing photocatalytic substance to photolyze and remove substances adhered to the surface of said protective layer as light is exposed.

5. A thermal head described in claim 4, wherein said photocatalytic layer is exposed to fixation light for optical fixation of an image recorded on said color thermal sheet.

6. A method for cleaning a thermal head provided in a color thermal printer, said thermal head being provided with an array of heating elements wherein plural heating elements are arranged lineally to record an image on a color thermal recording sheet, said method comprising the step of:

exposing light to a photocatalytic layer covering said array of heating elements so as to photolyze and remove substances adhered to the surface of said photocatalytic layer.

7. A method described in claim 6, said method further comprising the steps of:

driving a fixation lamp to generate fixation light for optical fixation of an image recorded on a color thermal recording sheet; and guiding said fixation light from said fixation lamp to said photocatalytic layer.

8. A method described in claim 7, said method further comprising the step of:

shifting a platen roller to nip said color thermal recording sheet with said array of heating elements away from said array of heating elements, said fixation light from said fixation lamp being reflected on a recording sheet guide toward said photocatalytic layer.

9. A method described in claim 7, said method further comprising the step of:

rotating a part of a reflection plate to cover said fixation lamp, said fixation light from said fixation lamp being reflected on a platen roller to nip said color thermal sheet with said array of heating elements, and said fixation light being reached to said photocatalytic layer.

10. A method described in claim 7, said method further comprising the step of:

swinging said fixation lamp and said array of heating elements so as to face each other.

11. A method described in claim 7, wherein cleaning of said thermal head is executed after recording at least one image.

12. A method described in claim 7, wherein cleaning of said thermal head is executed after a predetermined time has passed.

13. A method described in claim 7, wherein cleaning of said thermal head is before recording an image.

14. A color thermal printer for thermally recording an image onto a color thermal recording sheet, said color thermal printer comprising:

a thermal head provided with an array of heating elements wherein plural heating elements are arranged lineally;

a photocatalytic layer to cover said array of heating elements; and a lamp for exposing light to said photocatalytic layer to photolyze and remove substances adhered to the surface of said photocatalytic layer.

15. A color thermal printer described in claim 14, wherein said lamp is a fixation lamp illuminating fixation light for optical fixation of an image recorded on said color thermal recording sheet.

16. A color thermal printer described in claim 15, said color thermal printer further comprising:

a recording sheet guide for constituting conveyance path of said color thermal recording sheet, said recording sheet guide reflecting fixation light from said fixation lamp toward said photocatalytic layer.

17. A color thermal printer described in claim 15, said color thermal printer further comprising:

a platen roller to nip said color thermal sheet with said array of heating elements;

a reflection plate covering said fixation lamp; and a door attached to said reflection plate, swingable between a closing position for reflecting said fixation light and an opening position for letting said fixation light through to said platen roller, said fixation light being reflected on said platen roller and reaching said photocatalytic layer when said door is in said opening position.

18. A color thermal printer described in claim 15, wherein each of said fixation lamp and said thermal head is swingable, said fixation lamp illuminating fixation light toward said array of heating elements when both said fixation lamp and said array of heating elements swing to face each other.

* * * * *